US005345976A

United States Patent [19]

Lazzarotto

[11] Patent Number: 5,345,976

[45] Date of Patent: Sep. 13, 1994

[54] METHOD FOR A PNEUMATIC WEFT THREAD INSERTION IN AN AIR NOZZLE WEAVING LOOM

[75] Inventor: Alain Lazzarotto, St. Clair de la Tour, France

[73] Assignee: Lindauer Dornier GmbH, Lindau, Fed. Rep. of Germany

[21] Appl. No.: 65,613

[22] Filed: May 21, 1993

[30] Foreign Application Priority Data

May 21, 1992 [DE] Fed. Rep. of Germany ..... 4216749

[51] Int. Cl.[5] ..... D03D 47/30

[52] U.S. Cl. ..... 139/435.2; 139/435.5

[58] Field of Search ..... 139/435.2, 435.5, 194

[56] References Cited

U.S. PATENT DOCUMENTS

| | | | |
|---|---|---|---|
| 4,445,546 | 5/1984 | Hintsch | 139/435.2 |
| 4,532,964 | 8/1985 | Lerch | 139/435.2 |
| 4,759,392 | 7/1988 | van Bogaert et al. . | |
| 4,787,423 | 11/1988 | Hrus et al. | 139/435.2 |

FOREIGN PATENT DOCUMENTS

| | | | |
|---|---|---|---|
| 0112431 | 7/1984 | European Pat. Off. . | |
| 2328135 | 12/1974 | Fed. Rep. of Germany . | |
| 1-207440 | 8/1989 | Japan | 139/435.2 |

*Primary Examiner*—Andrew M. Falik

*Attorney, Agent, or Firm*—W. G. Fasse; W. F. Fasse

[57] ABSTRACT

In order to avoid or at least minimize weft thread breaking in an air nozzle loom, the supply of pressurized air to the relay nozzles is controlled in such a manner that the velocity of the blowing air is diminished toward the end of the weft thread insertion channel near its exit end. As a result, the tension on the weft thread is correspondingly reduced and the diminishing of the blowing air velocity can take into account any dynamic characteristics of the particular type of thread being inserted. Additionally, upon completion of the travelling weft thread insertion field, a weft thread tensioning field is imposed on the weft thread for properly tensioning the weft thread for the beat up. The tensioning following the insertion is applied only by selected nozzles or groups of nozzles, for example, by a group in the center of the weaving width and by a group toward the exit end of the insertion channel.

8 Claims, 1 Drawing Sheet

METHOD FOR A PNEUMATIC WEFT THREAD INSERTION IN AN AIR NOZZLE WEAVING LOOM

FIELD OF THE INVENTION

The invention relates to a method for the pneumatic insertion of a weft thread into the loom shed of an air nozzle weaving loom. In such looms a main nozzle and a plurality of relay nozzles provide the transport medium for carrying a weft thread through the loom shed. Blowing air is the preferred transport medium.

BACKGROUND INFORMATION

The relay nozzles in conventional air weaving looms generate a travelling field for transporting the weft thread. As the weft thread is exposed to the travelling field while moving through the weft thread insertion channel, a thread tension force is applied to the weft thread. The tension force depends on the flow speed of the air coming out of the relay nozzles. The tension force makes sure that the weft thread is stretched properly prior to beat up.

German Patent Publication 2,328,135 (Scheffel), published on Dec. 19, 1974, discloses a method for the weft thread insertion in nozzle weaving looms. The transport air is ejected by several relay nozzles distributed across the weaving width. The air or fluid streams are so controlled that the leading end of the particular weft thread is seized for transporting the weft thread, thereby pulling the weft thread through the insertion channel. More specifically, the relay nozzles are so controlled that the relay nozzle is switched on at the location where the leading end or tip of the weft thread travels at any particular instant. Thus, the nozzles according to the just mentioned German Patent Publication are referred to as pulling nozzles, although they are discharging pressurized air. As soon as the leading tip of the weft has passed the particular nozzle its air supply is switched off, with the exception of one or several nozzles distributed across the weaving width which continue to be supplied with pressurized air even after the weft thread tip has passed these nozzles. These few nozzles continue to receive pressurized air until the weft thread tip has passed entirely through the weaving width or rather through the insertion channel. This type of fluid flow control has shown in its practical application that tension force peaks occur at the end phase of the weft insertion, whereby weft breaks tend to occur. The cause for such weft breaks are believed to be due to the fact that the weft insertion speed is still relatively high even in the end phase of the weft insertion and that at the end of the weft insertion this relatively high speed must be abruptly reduced to zero by the action of the thread stopper which limits the weft thread length of each inserted weft thread.

When the weft thread is not inserted with the required speed, that is, if the speed of the flow medium that generates the weft pulling force is too low and the number of relay nozzles is too small, the result is a weft thread that is insufficiently tensioned which in turn causes the formation of loops which impair the fabric quality.

U.S. Pat. No. 4,759,392 (van Bogaert et al.), published on Jul. 26 , 1988, discloses a method and apparatus for controlling the operation of the relay nozzles on an air nozzle loom. The aim of the is known method and apparatus is to insert the weft thread with an optimal utilization of the airstream while using a minimal air volume to assure an insertion as perfect as possible. For this purpose, van Bogaert et al. disclose that the air nozzles are divided into groups. Initially, the nozzles of a first group are so controlled that a basic or first airstream for the weft insertion is generated, whereupon the nozzles of a second group of relay nozzles are controlled in such a manner that an additional or second airstream is generated which produces the tension force on the weft thread. The airstream of the nozzles in the first group has a speed which corresponds substantially to the programmed weft thread insertion speed . The airstream of nozzles forming the second group, however, has a substantially higher air speed than the given insertion speed for the weft thread.

Both methods and devices of the prior art discussed above disregard the fact that the product of the air flow speed $V_L$ effective on the weft thread , and the number n of the relay nozzles have a substantial influence on the size of the pulling force $F_G$ applied to the weft thread in addition to the influence of the speed $V_G$ of the weft thread itself and of the mass m of the weft thread. This means that depending on the size of the product $V_L \times n$ in the relationship $F_G = f(V_G, m, V_L \times n)$, weft thread breaks during the weft thread insertion will occur more frequently the larger this proportion $V_L \times n$ is in the just mentioned relationship. In the foregoing relationship "f" means function of the elements recited in the parenthesis .

European Patent Publication 0,112,431 (Lerch), published on Jul. 4, 1984, discloses a method for the operation of an air nozzle loom in which at least one relay nozzle is reactivated prior to the end of a weft insertion but after it has been switched off following the passage of the weft thread tip. The reactivation takes place at least once for supporting and tensioning the weft thread. Where several relay nozzles are reactivated, they form a trailing or follow-up field of blowing flows. In both instances the duration of each blow of the initial travelling field of insertion blows along the entire insertion channel is shortened in its duration and the flowing force needed to carry the weft thread through the insertion channel is made up by the above mentioned reactivation of at least one reactivation nozzle. The total "on-time" of the nozzles is thus reduced for reducing the required air volume. However, the problem of weft breakage is not solved by the teaching of EPO 0,112,431.

Thus, there is room for improvement to avoid or at least substantially reduce weft thread breaks while still efficiently using the insertion fluid.

OBJECTS OF THE INVENTION

In view of the foregoing it is the aim of the invention to achieve the following objects singly or in combination:

- to provide a method for the pneumatic weft thread insertion in air nozzle looms which optimally utilizes the weft thread transport energy of the insertion fluid, while simultaneously taking advantage of the mass inertia or the dynamic characteristics of the weft thread in the end phase of the weft thread insertion, namely primarily in the weft thread stretching phase so as to minimize the number of weft thread breaks;
- to take into account all parameters that influence the weft thread insertion to correspondingly control the travelling field of weft insertion blows that tension the weft thread; and to make sure that the tensioning of the weft thread is accomplished in a gentle manner and not abruptly while simultaneously making sure that the proper tensioning is achieved at the time just prior to the beat up motion of the reed.

SUMMARY OF THE INVENTION

The above objects have been achieved according to the invention by the following control of the airstreams of the auxiliary nozzles which carries the weft thread through the weft insertion channel of the reed in the manner of a travelling transport field. First, the travelling transport field is fully effective during the initial or entrance zone of the weft thread insertion. This initial zone is located next to the entrance end of the insertion channel. Second, during the end phase of the weft insertion, that is shortly before the weft thread has been completely inserted into the channel and is present in a stretched form, the travelling transport field is switched off, whereby for a short time duration the air flow velocity $V_L$ which influences the tension force on the weft thread, is reduced and the weft thread continues to travel only due to its inherent dynamics. As a result, during the time duration just prior to full insertion, the weft thread is present in a relatively unstretched or untensioned condition. Third, after the reduction of the air flow velocity $V_L$, a weft thread tensioning travelling field is established by a number of relay nozzles which is relatively smaller than the number relay nozzles required for establishing the travelling transport field. As a result, a tensioning force is again applied to the weft thread during the final phase of its insertion and the renewed tensioning force may correspond to or deviate from the initially applied tensioning force $F_G$.

The just described air flow control according to the invention makes it possible to perform the control dependent on the most varied parameters that have an influence on the weft thread insertion. Thus, the weft thread tensioning travelling field can now be established anywhere along the insertion width, for example, exclusively in the exit zone of the weft thread insertion channel, or it may be established along the entire weaving width. Further, it has been found to be practical to divide the weft thread tensioning travelling field into several field sections distributed over the weaving width. Thus, the invention assures a gentle tensioning of the weft thread, whereby weft thread breaks are substantially completely eliminated.

BRIEF DESCRIPTION OF THE DRAWINGS

In order that that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
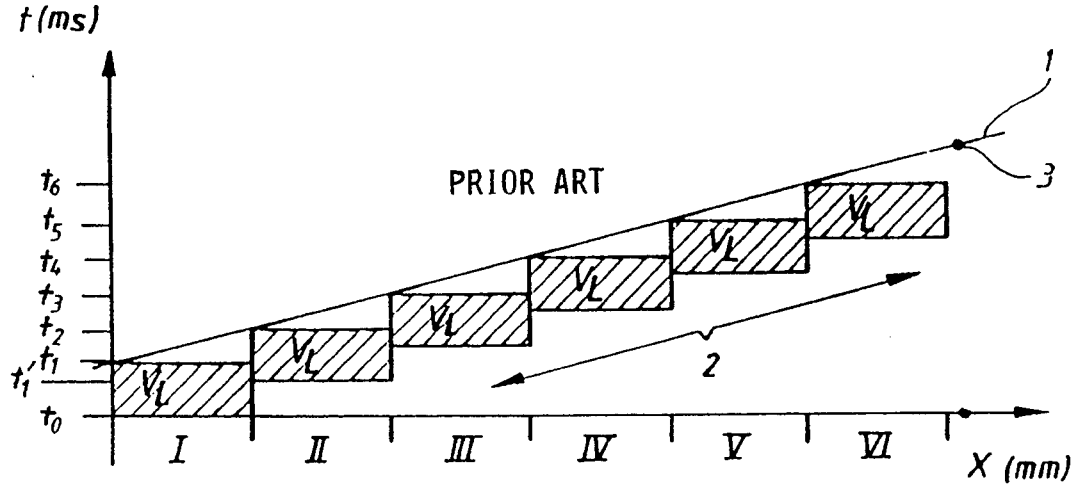
FIG. 1 illustrates a conventional control of a weft thread transport travelling field, whereby the ordinate shows time in milliseconds and the abscissa shows the weft thread insertion channel width in millimeters divided into several sections or nozzle groups.
Figure 2:
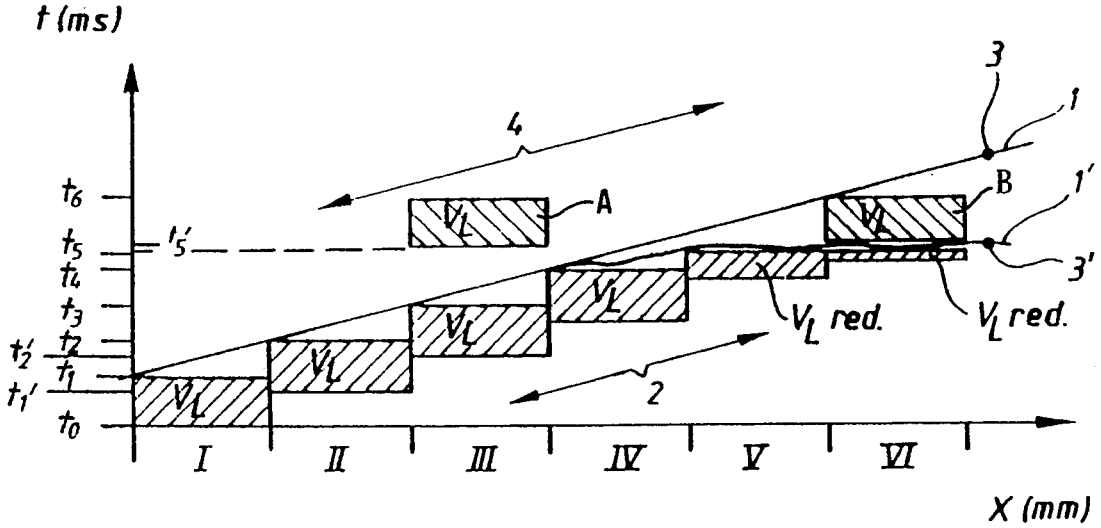
FIG. 2 is a view similar to that of FIG. 1, but illustrating the air control according to the invention with reference to an embodiment in which the air flow speed is reduced in the end phase of the weft insertion in which a different weft tensioning travelling field is established.

FIGS. 1 and 2 are described in conjunction so as to clearly compare the flow control according to the invention with a control according to the prior art which has been discussed above. Both FIGS. 1 and 2 show that the relay nozzles are divided into six groups I to VI of individual relay nozzles. These groups are distributed across the weaving width along the abscissa and generate a weft thread transporting travelling field 2 in FIG. 1, wherein the blowing duration of each group is the same and the time overlap shown on the ordinate is also the same from group to group. Please see the transport travelling field G in EP 0,112,431. This travelling transport field pulls the tip or leading end of the weft thread 1 through the insertion channel. Each individual relay nozzle is effective as a pulling or tensioning nozzle. As soon as the leading end of the weft thread has passed the nozzles of group I, for example, the air supply to that group is interrupted and the transport is taken over by the next following relay nozzle group II, for example. Thus, the relay nozzle groups I to VI are sequentially activated to blow a transport medium, preferably air, that has a predetermined pressure P. The flow ,control is accomplished by a conventional pneumatic closed loop control. Such a control makes sure that the air flowing out of each individual nozzle of each activated nozzle group has a predetermined velocity $V_L$ for pulling the weft thread 1 through the weft insertion channel.

Referring to FIG. 1 showing the conventional weft thread transport through the insertion channel, a single travelling transport field 2 is established by sequentially activating and deactivating the nozzles in the groups I to VI. The weft thread 1 shown as a straight line reaches point 3 with a relatively high insertion speed. This speed is influenced due to the relay type accelerations which impose on the thread a certain dynamic characteristic. Thus, the conventionally transported weft thread is already stretched and an additional or renewed activation of relay nozzle groups is not necessary. This known transport control does not take into account different thread or yarn qualities and yarn characteristics which result in different dynamic characteristics. As a result, frequent breaking of weft thread is unavoidable, resulting in switching off the loom for correcting the trouble.

European Patent Publication 0,112,431 (Lerch) mentioned above teaches that at least one of the relay nozzles that has been passed prior to the end of the weft thread insertion, is switched on once again for supporting and stretching the weft thread. However, such reactivation does not establish a second field solely for the purpose of weft tensioning as taught by the invention. Lerch teaches maintaining the travelling pressure wave or the respective air flow velocities of the first insertion travelling field constant and low over the entire weaving width to save air volume. To make up for this lower, constant blowing force at least one second insertion blowing is needed by Lerch with a certain time delay, whereby the insertion time is prolonged, slowing down the loom and reducing its efficiency. On the other hand, maintaining the insertion travelling field, or rather its air flow speed constantly higher across the entire insertion width causes weft thread breaks. Thus, there is a need for solving this problem by avoiding prolonging the insertion duration and reduced efficiency of the loom, while still assuring properly tensioned weft threads to produce a quality fabric.

FIG. 2 illustrates the air blowing control according to the invention. At the time $t_0$ the leading tip of the weft thread 1 is seized by the first effective relay nozzle of the first nozzle group I. The individual nozzles are not shown since at the time $t_1$. Prior to switching off the first group I, their positions along the insertion channel are well known. The duration of the operation of the first nozzle group ends at the time $t_1$. Prior to switching off the first group I, the second group II is switched on at the time $t_{1'}$. The blowing duration of the second group II ends at the time $t_{2'}$. The third group III is switched on at the time $t_{2'}$. According to the invention, the blowing duration t for each group remains constant up to and including group IV. Similarly, the timed rhythm of the activation and deactivation of the individual relay nozzle groups remains constant and so does the air flow velocity $V_L$ of the individual relay nozzles of the first four groups I, II, III, and IV.

Following the nozzle group IV, the remaining groups V and VI are switched on with a relatively shorter blowing duration t compared to groups I to IV. Similarly, the nozzles of groups V and VI are operated with a reduced air flow velocity $V_{Lred}$. According to the invention this reduction of the air flow velocity is possible because the invention takes advantage of the dynamic characteristic of the weft thread being inserted. It has been found that the weft thread in this position has such a dynamic characteristic that it will reach the intended end position 3' without any problems. Due to the reduction of the blowing velocity $V_L$ in stages V and VI according to the invention, the weft thread 1 is not quite as stretched. This characteristic is indicated in an exaggerated manner by showing the portion 1' of the weft thread as a wavy form.

Upon completion of the travelling weft thread transporting field 2' which as shown has reduced air flow velocities $V_{Lred}$ at least during the operation of groups V and VI, according to the invention, a weft thread tensioning field 4 is applied to the weft thread as shown in FIG. 2. The weft thread tensioning travelling field 4 is established at a point of time $t_5$ at which time all or at least one group V or VI has been effective with a reduced air velocity $V_{Lred}$. Preferably, the tensioning field 4 is started at a time $t_{5'}$ at which the groups IV and V have been partially or completely switched off. The tensioning field 4 is established in that, for example, the nozzle groups V and VI are switched on for short time durations, either in a relay sequence or simultaneously at the time $t_{5'}$. Thus, charging these nozzles with pressurized air stretches the weft thread 1' so that beat up may take place. FIG. 2 shows further that the tensioning field 4 may be established with sections that are distributed across the weaving width X. For example, it is possible to simultaneously operate nozzles of group III and group VI either in a relay sequence or not in a relay sequence as indicated by the boxes A and B in FIG. 2. Insertion is completed at $t_6$.

Although the invention has been described with reference to specific example embodiments, it will be appreciated that it is intended to cover all modifications and equivalents within the scope of the appended claims.

What I claim is:

1. A method for controlling flows for the pneumatic insertion of a weft thread through a weft insertion channel in a nozzle loom having a plurality of weft insertion nozzles, comprising the following steps:

(a) establishing a weft thread insertion travelling field of sequentially effective blowing jets emanating from said weft insertion nozzles, said sequentially effective blowing jets having a first flow speed ($V_L$) for carrying said weft thread through said weft insertion channel, (b) reducing said first flow speed of said sequentially effective blowing jets in an end zone along an exit end of said weft insertion channel sufficiently to establish a second flow speed ($V_{Lred}$) to slacken said weft thread in said end zone; and (c) then generating again a further flow speed of said sequentially effective blowing jets to form a weft tensioning field just sufficient to straighten said weft thread again for reducing weft thread breakage.

2. The method of claim 1, wherein said weft tensioning field is generated as a travelling weft tensioning field by sequentially activating said plurality of weft insertion nozzles.

3. The method of claim 1, wherein said step of reducing said flow speed is performed by completely switching off said weft insertion nozzles in said end zone.

4. The method of claim 1, wherein said step of reducing said flow speed is performed by partially switching off said weft insertion nozzles in said end zone.

5. The method of claim 1, establishing said weft tensioning field in said end zone.

6. The method of claim 1, comprising dividing said weft tensioning field into a plurality of sections, and distributing said weft tensioning field sections along said weft insertion channel.

7. The method of claim 6, wherein each weft tensioning field section is formed by a plurality of nozzles thereby producing each of said tensioning field sections as a travelling tensioning field section.

8. The method of claim 1, wherein said blowing jets are air jets.

* * * * *

UNITED STATES PATENT AND TRADEMARK OFFICE

CERTIFICATE OF CORRECTION

PATENT NO. : 5,345,976
DATED : September 13, 1994
INVENTOR(S) : Alain Lazzarotto It is certified that error appears in the above-indentified patent and that said Letters Patent is hereby corrected as shown below:

Column 1, line 67, replace "the is" by --this--;

Column 5, line 8, after "since" insert --their positions along the insertion channel are well known. The duration of the operation of the first nozzle group ends--;

line 9, delete "their positions along the insertion channel";

lines 10 and 11 are deleted;

line 12, delete "off the first group I,";

line 14, replace "$t_2$' " by --$t_2$--.

Signed and Sealed this

Fifteenth Day of November, 1994

*Attest:*

*Attesting Officer*

BRUCE LEHMAN

*Commissioner of Patents and Trademarks*